United States Patent [19]

Frantl et al.

[11] Patent Number: 4,902,159

[45] Date of Patent: Feb. 20, 1990

[54] JOINT CONNECTION FOR FRAME STRUCTURES

[75] Inventors: Erich Frantl; Peter Hofstätter; Willibald Zemler; Albert P. Raunicher; Werner Frantl, all of Vienna, Austria

[73] Assignee: Dipl.-Ing. Manfred Beer, Modling, Austria

[21] Appl. No.: 2,901

[22] Filed: Jan. 13, 1987

[30] Foreign Application Priority Data

Jan. 14, 1986 [AT] Austria ..... 67/86

[51] Int. Cl.[4] ..... F16B 7/00

[52] U.S. Cl. ..... 403/171; 403/268; 403/218

[58] Field of Search ..... 403/266, 268, 267, 277, 403/170–172, 176, 248, 253, 263, 245, 361, 218

[56] References Cited

U.S. PATENT DOCUMENTS

| | | | |
|---|---|---|---|
| 639,948 | 12/1899 | Sundh | 403/245 X |
| 3,914,060 | 10/1975 | Miller et al. | 403/171 |
| 4,011,020 | 3/1977 | Frantl et al. | 403/172 |
| 4,127,741 | 11/1978 | Bauer et al. | 403/361 X |
| 4,194,851 | 3/1980 | Littlefield | 403/218 |
| 4,591,286 | 5/1986 | Inchaurbe | 403/170 |
| 4,776,721 | 10/1988 | Lange | 403/171 |

FOREIGN PATENT DOCUMENTS

| | | |
|---|---|---|
| 1781162 | 7/1971 | Fed. Rep. of Germany . |
| 255891 | 2/1949 | Switzerland . |

*Primary Examiner*—Andrew V. Kundrat
*Assistant Examiner*—Peter M. Cuomo
*Attorney, Agent, or Firm*—Beveridge, DeGrandi & Weilacher

[57] ABSTRACT

A joint having a plurality of bars inserted through apertures into a metal casing adapted to be filled with a grout is disclosed. The casing has projecting members that taper in stepwise fashion from an enlarged portion covering the apertures.

6 Claims, 1 Drawing Sheet

Fig.1
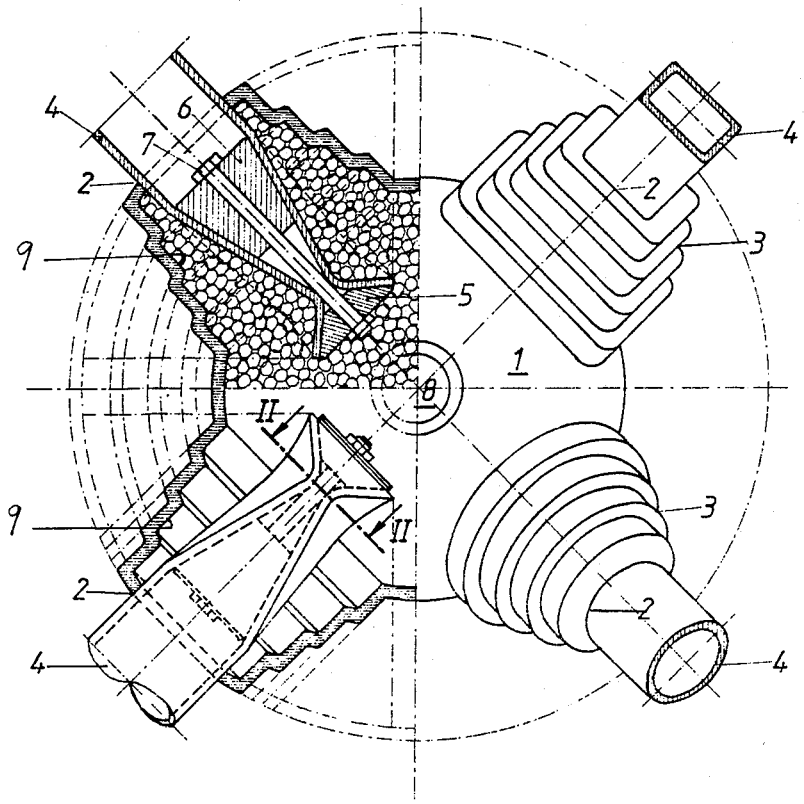
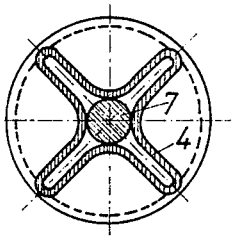
Fig.2
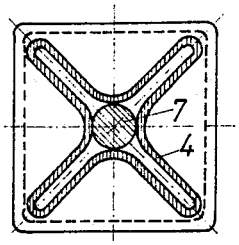
Fig.3
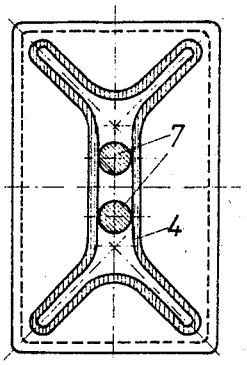
Fig.4

JOINT CONNECTION FOR FRAME STRUCTURES

BACKGROUND OF THE INVENTION

The invention relates to a joint for framed structures with more than two bars connected at the joint. More particularly, the invention relates to a joint wherein the more than two bars are inserted through apertures into a metal casing adapted to be filled with a hardening grout, wherein the end portions of the bars form a positive connection in the metal casing and wherein, if necessary, the end portions are reshaped, more particularly necked down.

In joints known from the prior art as exemplified in British Patent 271,709, a relatively large metal casing is necessary to provide for absorbtion of the tensile forces acting on the bars. Where the outside surface of the metal casing is shaped, for example, as a sphere or similar convex case, the radius of the casing must at least equal the extent to which the bars are inserted into the metal casing. The bulky joints required are not only offensive to view, they also cause problems when being filled with grout. A correspondingly large quantity of expensive grout is needed, the weight of which plays a considerable role in relatively large framed structures and the cost of which increases the total cost of the structures. The same problems exist in the case of a joint such as disclosed in Austrian Patent 339,094.

SUMMARY OF THE INVENTION

The major object of the invention is to provide a joint of the type referred above which will be adequate for smaller joints.

This object is achieved with a joint of the type mentioned above by providing the metal casing with tapering projections. Consequently, only small portions of the metal casing are required to project outwardly as determined by the extent of insertion of the bars into the metal casing such portions include the projections located at the apertures. All portions of the metal casing that are removed from its apertures can have much smaller outer dimensions.

According to the invention, provision can be made for the projections of the metal casing to taper in stepwise fashion.

In one embodiment of the invention, the projections stellatedly extend from a convex central portion of the metal casing, which portion preferably has a substantially spherical or flattened spherical form. The projections tapering outwardly from the apertures in the metal casing are comprised of a series of hollow portion or hollow elements that increase in cross section with decreasing distance from the apertures and that are securely attached to each other and to the convex central portion of the metal casing, or are formed in one piece therewith. As a result, tensile forces acting on the bars and their positive-connection-forming end portions can be transmitted to the metal casing by a pressure cone developing in a hardened grout extactly as if radial entire metal casing had the dimensions equalling the outward extension of the projections. The hollow portions of the step-like projections absorb the tensile forces from one step to the next. The compressive forces acting on the bars are transmitted directly into the hardened grout by the closed ends of the bars. The grout is anchored internally by the ends of the other bars and the metal casing.

BRIEF DESCRIPTION OF THE DRAWINGS

The invention will be explained in greater detail with reference to the drawings in which the parts bear like reference numerals. In the drawings:

FIG. 1 is an elevated front view in partial cross-section along the axis of one of the bars in the joint according to the present invention; and FIGS. 2 through 4 are cross-sectional views taken along line II—II of FIG. 1 of various embodiments of the joint of the present invention.

DETAILED DESCRIPTION OF THE PREFERRED EMBODIMENTS

A joint according to a preferred embodiment of the present invention is comprised of a metal casing 1 having a convex central portion substantially in the form of a flattened sphere. Protruding stellatedly from the central portion, projections 3 have inner walls 9 which taper in step-wise fashion from aperture 2 in the metal casing.

In the right portion of FIG. 1 (not shown in cross section) is indicated an aperture 2 receiving a bar 4 in the form of a tube with a square cross section and another aperture 2 receiving a bar 4 in the form of a tube with a circular cross section. One advantage of the joint connection according to the invention is in that the bars 4 are not required to have the same cross section. For example, diagonal members could be made thinner chord members.

In the left portion of FIG. 1 are shown, linked by the joint, two bars, the axis of which lies in the plane of the drawing. A filling filling material in the metal casing 1 is shown in the upper part of the left half of FIG. 1. This filling material is not shown in the lower part of the left half of FIG. 1 and also the end portion of the bar 4 is not shown in cross section therein.

It is apparent that bars 4 have a necked down end portion that forms a positive connection in the metal casing. It can be seen from the cross-sectional views of the necked-down end portions of bars 4 in FIGS. 2 to 4 that the neck is formed by folding the tube wall without thinning or altering its cross-sectional area.

In each necked-down end portion of bars 4, two inserted members 5 and 6 are mounted in opposing sections of the neck and oriented therein with their tapering portions facing in opposition. The neck is adapted to the shape of the inserted members 5, 6. By means of a tensioning member 7 in the form of a high-strength bolt or a plurality of such bolts (FIG. 4) located in the tube axis, the two inserted members 5, 6 are urged together longitudinally within the end portion of each the bar 4 such that the members 5, 6 come into flatwise abutting engagement with the inside walls of the tubes in opposite sections of the neck.

On the top side of the metal casing 1, a filling aperture 8 is provided for filling the casing with hardening grout.

In FIG. 1, particularly the left half thereof, projections 3 are shown as integrally formed with the metal casing 1. Each projection 3 is formed from a series of hollow portions which, as seen from FIG. 1, decrease in cross-section with increasing distance from casing 1 so that their inner walls 9 taper in step-like fahshion from the casing. Alternatively, projections 3 could be formed from a plurality of hollow elements which are attached to each other and the outer surface of the metal casing 1.

The end portions of the bars 4 are received within the metal casing 1 and form positive connections with the hardened grout. The grout is confined by the casing 1. As a result, tensile forces, acting on bars 4 and their positively-connected end portions, are transmitted to the metal casing 1 as if the entire casing had a radius equalling at least the extension of the bars therewithin. The tensile forces are transmitted to the casing by a pressure cone which develops in the hardened grout. The bars 4 directly transmit compression forces, acting thereon, to the hardened grout.

Only portions of the casing 1, namely projections 3, are required to project outwardly a distance at least equalling the inward extension of bars 3 to within the casing. Portions of the casing 1 which are remote from the bar-receiving apertures 2 can have much smaller dimensions. Thus, the size of the resulting joint according to the present invention is greatly reduced.

We claim:

1. A joint for frame structures, said joint comprising:

a metal casing having a plurality of openings therein, said plurality comprising at least three openings;

a corresponding plurality of tubular projecting members, each of said members being affixed to said casing in axial alignment over an associated one of said openings, said projecting members having outer walls and inner walls, said inner walls tapering in step-wise fashion from an enlarged portion affixed to said casing to a narrow portion remote from said casing; and at least three elongate members, each having an end portion which extends through an associated projecting member and opening to within the interior of said casing, said end portions each comprising a crimped portion, said casing being adapted to be filled with a hardenable grout for providing a positive connection for said end portions received in said casing.

2. A joint as claimed in claim 1, wherein said casing is substantially spherical and said projections extend stellatedly from the surface of said casing.

3. A joint as claimed in claim 1, wherein said casing has a flattened spherical shape and said projections extend stellatedly from the surface of said casing.

4. A joint as claimed in claim 1, wherein said inner walls comprise a plurality of steps.

5. Means for connecting at least three elongate members to form a joint for frame structures, said means comprising:

a substantially spherical metal casing having at least three openings therein; and a plurality of tubular, hollow members corresponding to the number of openings in said casing, each of said hollow members being affixed to said casing in axial alignment over an associated one of said openings, each of said members having outer walls and inner walls, said inner walls tapering in step-wise fashion from an enlarged portion affixed to said casing to a narrow portion remote from said casing, said tubular, hollow members projecting stellatedly from said casing.

6. A joint as claimed in claim 5, wherein said inner walls comprise a plurality of steps.

* * * * *